United States Patent [19]

Swanic

[11] Patent Number: 4,808,127

[45] Date of Patent: Feb. 28, 1989

[54] CONNECTOR ASSEMBLY

[75] Inventor: Anthony Swanic, Las Vegas, Nev.

[73] Assignee: Arbus, Inc., Las Vegas, Nev.

[21] Appl. No.: 132,611

[22] Filed: Sep. 28, 1987

Related U.S. Application Data

[63] Continuation of Ser. No. 788,950, Oct. 18, 1985, abandoned.

[51] Int. Cl.[4] ..... H01R 13/44; H01R 13/62

[52] U.S. Cl. ..... 439/139; 439/140; 439/141; 439/252; 439/263; 439/320

[58] Field of Search ..... 439/137–141, 439/252, 256, 263, 320, 339, 340, 370, 376, 592–594, 588

[56] References Cited

U.S. PATENT DOCUMENTS

| | | | |
|---|---|---|---|
| 2,563,712 | 8/1951 | Frei et al. | 339/63 M |
| 2,563,713 | 8/1951 | Frei et al. | 339/63 M |
| 3,271,725 | 9/1966 | Bloch | 439/141 |
| 3,845,450 | 10/1974 | Cole et al. | 439/141 |
| 4,109,989 | 8/1978 | Snyder, Jr. et al. | 439/140 |
| 4,203,640 | 5/1980 | Bice et al. | 439/139 |
| 4,214,802 | 7/1980 | Otani et al. | 339/63 M |
| 4,592,609 | 6/1986 | Kasai et al. | 339/40 |

FOREIGN PATENT DOCUMENTS

| | | | |
|---|---|---|---|
| 533338 | 11/1954 | Belgium | 339/41 |
| 1202374 | 10/1965 | Fed. Rep. of Germany | 339/42 |

*Primary Examiner*—Gil Weidenfeld
*Assistant Examiner*—P. Austin Bradley
*Attorney, Agent, or Firm*—William A. Knox

[57] ABSTRACT

A connector assembly comprises a female connector having a protruding portion extending from one end and with one or more sockets therein and a male connector having one or more pins for being received in a different one of the sockets and a retractable pin shield member in which the pins are recessed when the shield member is in a forward position. The pin shield member includes a cavity for receiving the protruding portion of the female connector and as the connectors are progressively engaged the protruding portion is urged against the shield member causing it to become gradually retracted and exposing the pins which are then progressively received in the sockets of the female connector.

9 Claims, 3 Drawing Sheets

CONNECTOR ASSEMBLY

RELATION TO OTHER APPLICATIONS.

This is a continuation of U.S. Patent Application No. 788,950, filed 10-15-85 and now abandoned.

BACKGROUND OF THE INVENTION

Mating connector assemblies are widely used in a number of environments, especially for electrical connections using a male connector with pins received in sockets in a female connector member. A problem of easily aligning the connectors exists with misalignment resulting not only in the difficulty of mating the connectors, but during the connector engagement, broken, bent, or otherwise damaged pins is common. Moreover, where the connectors are to be mated in remote environments, under poor visibility conditions or otherwise where easy alignment is difficult, poor connector body alignment design causes difficult and time-consuming problems to the user. It is to the elimination of such problems that the assembly of the present invention is directed.

SUMMARY OF THE INVENTION

The connector assembly of the present invention offers significant advantages over present connectors by improving the ease at which the connector bodies are mated, even under conditions where the user or installer is unable to observe the components. Such a feature is especially advantageous when the connectors are to be assembled or mated at remote locations using instruments or robots, when the installer has bulky gloves or otherwise is handicapped and cannot readily guide the two connectors during the mating, or otherwise under poor or non-existent visibility conditions and the like. The unique connector assembly of the present invention, in its preferred embodiment, utilizes a pair of nesting trapezoid-shaped members, one containing the pins and the other the sockets for receiving the pins. Such a feature allows for simplified alignment of the connector components and substantially eliminates the possibility of misalignment regardless of the conditions under which the connectors are mated. The improved assembly of the invention also includes a retractable pin shield member in which the pins are recessed until progressive engagement of the male and female connector components is initiated. Such a feature prevents the possibility of damaging the pins at all times prior to and during mating of the connector components. These as well as other advantages will be evident from the following detailed description.

DETAILED DESCRIPTION OF THE INVENTION

Figure 1:
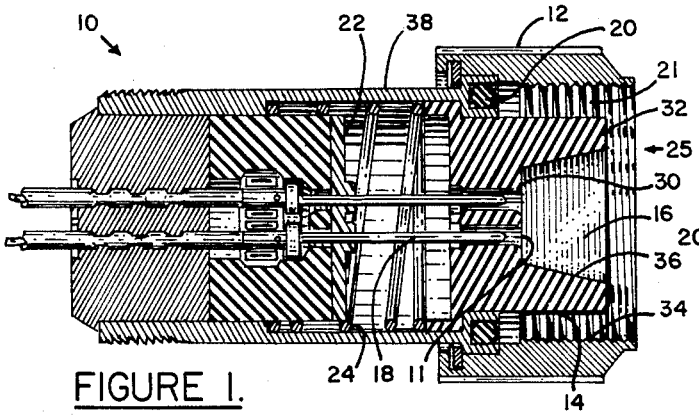
FIG. 1 is a side sectional elevation of the male connector of the invention.
Figure 2:
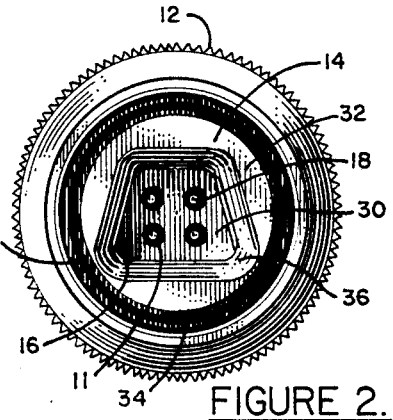
FIG. 2 is a front view of the connector of FIG. 1.

In FIGS. 1 and 2 the male connector of the connector assembly of the invention is illustrated. The male connector 10 incorporates a pin shield 14 which is exposed at the forward or mating end 25 of the connector. The pin shield includes a cavity 16 having a floor 30, the cavity being trapezoidal in shape as shown in FIG. 2. In the floor of the cavity are one or more ports 11 for the channel in which pin 18 is located. The pin shield is slideable and retractable from a first position as shown in FIG. 1 in which the pins are entirely protected and covered or recessed within the channels of the pin shield. The pin shield is urged in the first position by a biasing means, suitably a compression spring 24. Thus, the pins are totally recessed until such time as mating of the connectors is initiated thereby obviating the possibility of damaging the contacts prior to connector mating.

In the embodiment shown, the male connector also includes a coupling nut 12 having threads 34 on its interior surface for progressively engaging the female connector as will be explained in more detail hereinafter. The coupling nut is secured on the male connector body 38 and is conveniently rotated by hand, preferably including a knurled or slotted outer surface for improving the touch or grip on the nut as it is rotated. Located between the threaded surface 34 of the coupling nut 12 and the exterior of the pin shield is slot 21 for receiving an annular collar of the female connector as will be explained further hereinafter. At the bottom or floor of the slot is a gasket 20 for forming a seal with the annular collar when the male and female connectors are fully engaged. Located behind the pin shield is a seal member 22 for engaging and sealing the back of the pin shield when it is in the fully retracted condition. Gasket 20 may also be in the form of an O-ring or any other suitable configuration for forming an air or fluid-tight seal when the male and female components are fully engaged.

The pins may be supported in the male connector by any suitable means such as supports, insulators and the like. Moreover, appropriate electrical connection means, wires, conduits, cables and the like, may also be secured to the pins in the male connector for its intended purpose and function. Moreover, any number of pins may be used in the device, and although four are shown, only use and connector size limitations will dictate the number of pins which may be incorporated into such a device.

Figure 3:
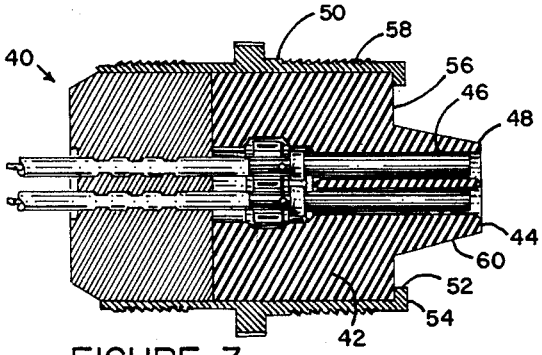
FIG. 3 is a side sectional view of the female connector of the invention.
Figure 4:
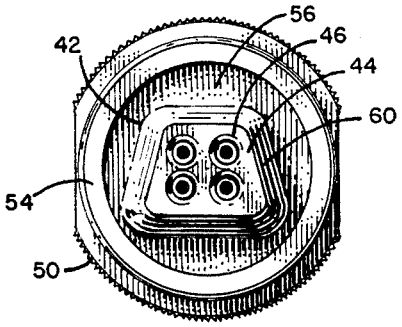
FIG. 4 is a front end view thereof.

Female connector 40 is illustrated in FIGS. 3 and 4 the component including insulator 42 having a protruding portion 48 at the forward end and one or more sockets 46 each having a port or otherwise exposed at the forward or front surface 44 of the insulator. Each of the sockets is for receiving a different one of the pins in the male connector. The female connector also includes means for being secured to the male connector when the connectors are mated. In the embodiment shown, such a means comprises a threaded surface 58 for engaging the threads of the coupling nut 12 of the male connector. Threaded surface 58 may be simply formed on the exterior surface of female connector casing 50 and positioned so that once pin shield 14 of the male connector is in nested engagement with protruding portion 48 of the female connector, by simply rotating the coupling nut, it will begin to threadedly engage the female connector.

Protruding portion 48 is also of a shape to be received in nested engagement with cavity 16 of the male connector. The shape of the two mating and nesting protruding portion and cavity components must be such that the connectors can be mated and engaged only from a single relative axial alignment or orientation. According to the preferred embodiment of the invention, both the cavity and the protruding portion have a trapezoidal cross-sectional shape as illustrated in FIGS. 2 and 4. The size of the respective components is such that protruding portion 48 fits in nested engagement within the cavity once the components are properly aligned and engagement of the connectors is initiated. To further enhance or improve the alignment of the connectors, the trapezoidal cavity and protruding portion are preferably tapered along their side mating surfaces which feature assists the user in guiding the components together. Tapered surface 36 along the interior side of cavity 16 is illustrated in FIG. 2 while tapered surface 60 of protruding portion 48 is shown in FIG. 4. With such complementary cavity and protruding portion shapes, positive and exact alignment of the connectors is assured. Moreover, because of the advantageous nesting shape of the mating cavity and protruding portion components, alignment is significantly simplified even under remote mating conditions or where the operator cannot see to align the mating components. By the term "nested" herein, it is intended to mean that the exterior surface of the protruding portion of the female member substantially fully contacts the interior cavity surface of the male connector when the components are engaged or mated. This feature will prevent misalignment or other inaccuracies in positioning the relative device thus permitting remote mating of the connectors by robots, or for example, in adverse conditions such as underwater, in space, or in radioactive environments where the operators hands are heavily gloved or covered.

Figure 5:
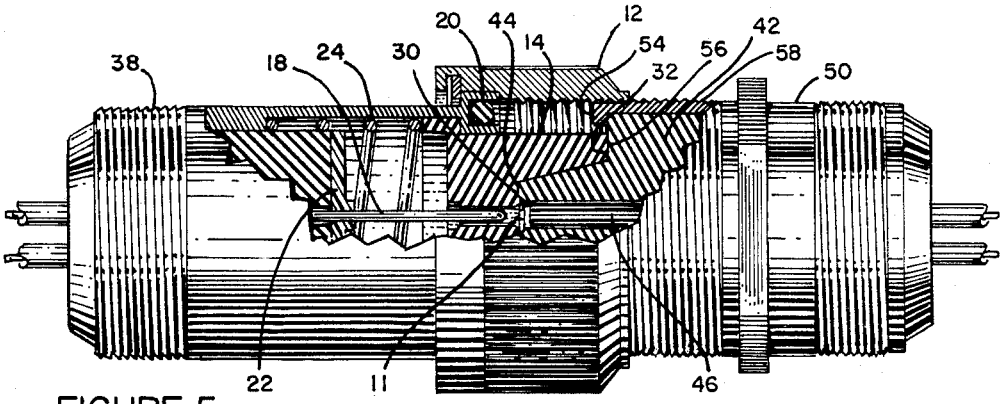
FIG. 5 is a side view, partially in section, of mating male and female connectors in a first or initial mated condition.
Figure 6:
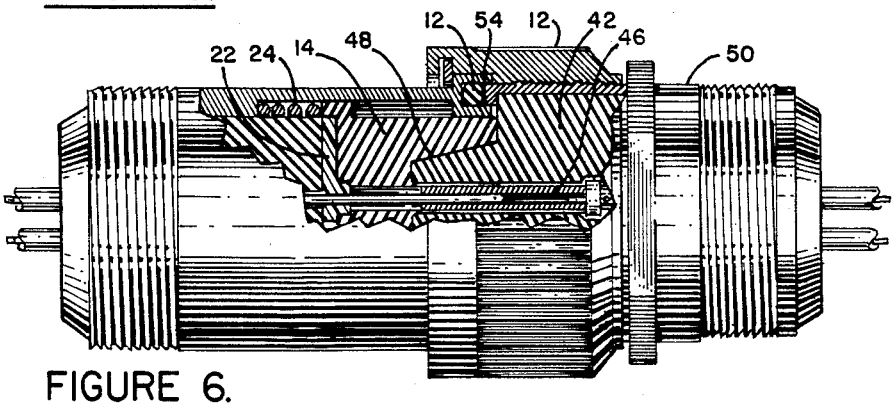
FIG. 6 is a side view, partially in section, of the mating connectors in fully engaged or secured condition.
Figure 7:
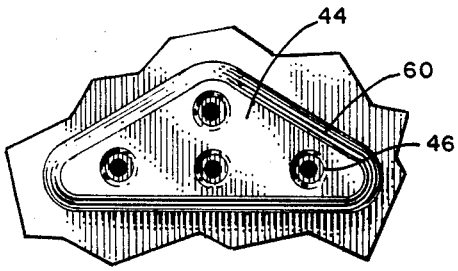
FIGS. 7–10 are front end views of protruding portions of other female connector embodiments illustrating examples of different shapes.
Figure 8:
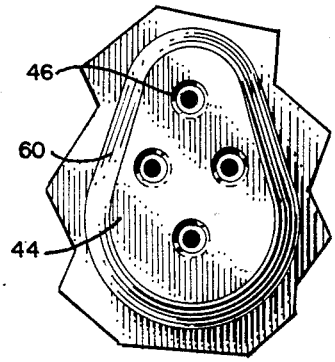
Figure 9:
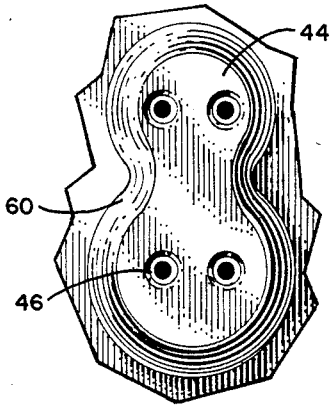
Figure 10:
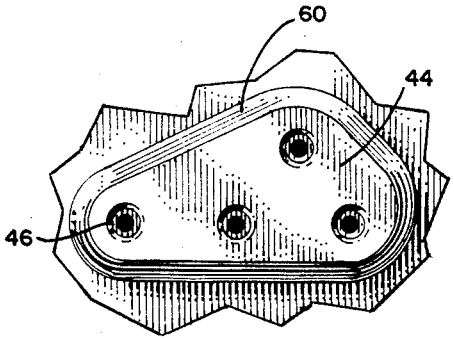

As previously noted, pins 18 are recessed and protected within pin shield 14 at all times when the pin shield is in the forward position illustrated in FIG. 1 as it is urged by spring 24. The pin shield will remain in this forward and pin-protecting position until it is retracted during progressive coupling or mating of the connectors during which it becomes gradually retracted rearwardly with concomitant gradual exposure of the pins within cavity 16. Observing further FIGS. 5 and 6, progressive engagement of the connectors is illustrated. In the initial mated condition the protruding portion of the female connector is first nested within cavity 16 of the male connector as shown in FIG. 5. The final fully engaged or secured condition in which the pins are received in the sockets of the female connector is illustrated in FIG. 6. In mating the connectors, the respective components are axially rotated relative to one another until the protruding portion and cavity are aligned along their complementary trapezoidal surfaces. The connectors are then pushed together until the protruding portion is fully nested in the cavity of the male connector. This initial condition illustrated in FIG. 5 shows forward surface 44 of the protruding portion abutting floor 30 of the cavity of pin shield 14. Further contact of the mating components is made with forward pin shield face surface 32 abutting surface 56 of the female connector. Thus, even during initial mating of the components prior to commencement of progressive engagement, snug and abutting contact of the pin shield and female connector insulator components is achieved.

Once the initial alignment and mating of the connectors has occurred, progressive engagement begins by rotating the securing means in the form of the threaded coupling nut 12 onto the complementary threaded surface of the female connector. As the coupling nut is rotated, the protruding portion of the female connector urges the pin shield rearwardly against the force of compression spring 24. Progressive engagement continues with the pins gradually exposed through pin channel ports 11 and progressively received in sockets 46. Progressive engagement continues until the respective female and male connector components are fully engaged and secured. Such a condition is shown in FIG. 6 with annular collar 54, having an inner surface 52, snugly abutting gasket or O-ring 20. In this condition it will be observed that all of the components of the connector bodies are compressed against or abutting each other thereby substantially eliminating air spaces which further improves operation or performance of the device by reducing current leakage paths, thereby allowing the connectors to be operated at high voltages. Moreover, because of the compressive action of the spring urging the retractable pin shield in the forward position, a positive pressure is applied on the mated threads of the respective connector components substantially reducing the possibility of separation and loosening of the connectors by vibration, shock, "g" forces, and the like. The coupling nut may also be located on the female connector with threads on the male connector. Although threaded engagement and locking of the components is shown, other locking means may be used.

In FIGS. 7–10 are illustrated examples of other female connector protruding portion shapes. Corresponding components have the same numeral designations triangle is shown, in FIG. 8 an egg shape, in FIG. 9 a FIG. 8 shape and in FIG. 10 a scalene triangle. Such alternatives are shown by way of example to illustrate other shapes which may be used for the protruding female connector portions and the complementary cavity of the pin shield in which the protruding portion is received and nested. Other shapes may also be used, the critical limitation being that the respective protruding portion and cavity shapes must be engagable and nested in only a single possible relative axial orientation or alignment. Triangular shapes in which at least two sides are of different lengths are useful as are a variety of other shapes with straight and/or curved or rounded sides and/or corners which will be evident to those skilled in the art.

As previously noted, the connector assembly of the invention will find substantial uses for electrical or electronic components requiring connection or joining of wires, electrical harnesses, and other conventional electrical contacts made at the ends of the respective connectors opposite the mating surfaces. However, the device will also find substantial use for other applications including optical fiber devices in which optical fibers are substituted in the connectors for the electrical components illustrated. The connectors may also be used for making fluid (gas or liquid) connections or joints as well as in any other field where connecting devices are used.

Figure 12:
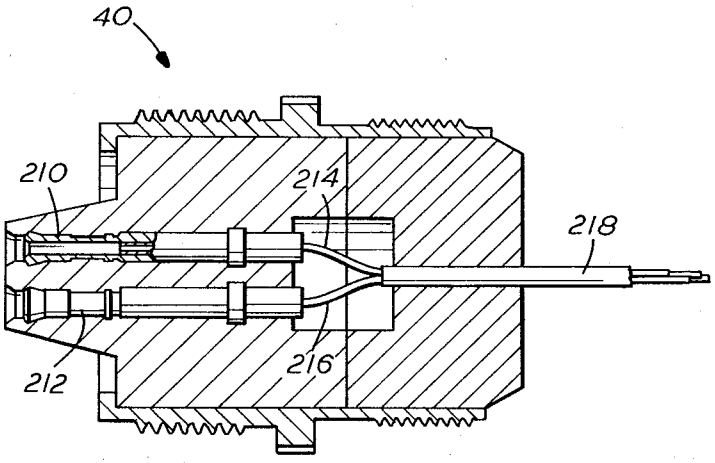
FIG. 12 is a side sectional elevation of the female connector of the invention adapted for use with optical fibers.
Figure 11:
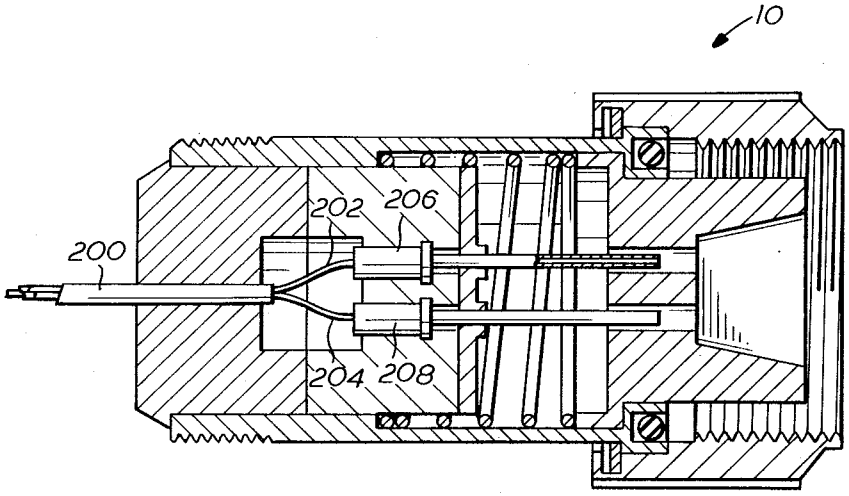
FIG. 11 is a side sectional elevation of the male connector of the invention adapted for use with optical fibers.

FIGS. 11 and 12 show in side sectional elevation, an optically conductive adaptation of the connector assembly of this invention. In the male connector 10, FIG. 11, an optical-fiber bundle 200 of any well known type enters the left hand end of the connector and is sealed in place by any convenient means. Individual fibers in the bundle such as 202 and 204 are fanned out as shown and are inserted into the respective ferrules such as 206 and 208 wherein they are expoxied into place. The ends of the fibers, protruding from the right hand ends of the hollow ferrules, are cleaved and polished flush with the ferrule ends. Similarly, suitable optical-fiber sockets 210 and 212 are mounted in the female connector of FIG. 12. The polished ends of fibers such as 214 and 216 are exposed at the bottoms of the sockets 210 and 212 and held in place by epoxy in the usual manner. Fibers 214 and 216 are collected into fiber bundles 218 and exit from the right hand end of connector 40, FIG. 12. When the connectors are mated and secured together, the polished ends of the respective fibers 206 and 208 abut the polished ends of corresponding fibers 214 and 216 that are embedded in the bottoms of sockets 210 and 212.

Figure 14:
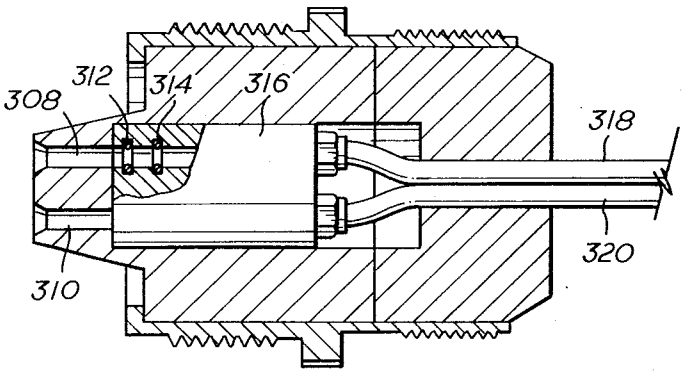
FIG. 14 is a side sectional elevation of the female connector of this invention for use with fluids.
Figure 13:
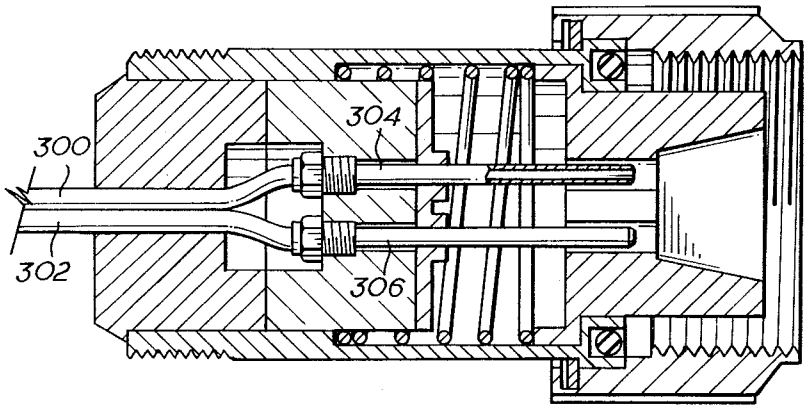
FIG. 13 is a side sectional elevation of the male connector of this invention adapted for use with fluids.

FIGS. 13 and 14 demonstrate in side view, a fluidly-conductive version of the connectors of the invention. Individual fluid lines such as 300 and 302, which may be flexible, enter the left end of connector 10, FIG. 13, where they are connected to rigid hollow conduits such as 304, 306 which are substituted for the pins 18 of FIG. 1. The female connector 40, FIG. 14, includes rigid hollow, socket-like orifices 308,310 which are drilled in a holder or manifold 312. Orifices 308 and 310 have a diameter slightly larger than that of the hollow conduits 304 and 306. O-rings such as 314 and 316, shown inside orifice 308, serve as gaskets to render the connections fluid-tight when the connectors are mated. O-rings are provided for other orifices similarly. Suitable outlet lines 318 and 320 are, of course installed at the left end of connector 40, FIG. 14. In FIGS. 11–14, the reference numbers for previously-identified parts are not duplicated to avoid undue complexity of the drawings. From the above description it will be observed that the design of the components allows for precise initial alignment even under adverse environmental conditions as well as eliminating the problem of pin and socket damage due to improper connector alignment. Because of the retractable pin shield feature, the possibility for contact breakage at the time of initial alignment is obviated because the pins are not exposed until progressive locking of the mated components is initiated. These as well as other advantages and uses of the connector assembly of the invention will be understood by those skilled in the art as will be modifications and adaptations of the components within the purview of the invention described herein.

I claim:

1. A connector assembly comprising:

a female connector having one or more sockets therein each for receiving a pin and a protruding portion containing said sockets extending from one end of said connector, each of said one or more sockets having a pin entry port exposed on said protruding portion, a male connector having one or more pins therein each for being received in a different one of said sockets in said female connector, and a pin shield member having a cavity which contains said pins for receiving said protruding portion of said female member and movable between a forward position wherein said pins are recessed therein and a retracted position wherein said pins are exposed from said shield member, and means for urging said pin shield member in said forward position, said pin shield cavity and said protruding portion having shapes such that the protruding portion is constrained to rotate so as to be received in said cavity and in nested engagement therein in only a single relative axial alignment.

2. The connector assembly as defined by claim 1, wherein said pins and sockets are electrically conductive.

3. The connector assembly as defined by claim 1, wherein said pins and sockets are optically conductive.

4. The connector assembly as defined by claim 1, wherein said pins and sockets are fluidly conductive.

5. The connector assembly of claim 1 including releasable securing means for connecting said female and male connectors.

6. The connector assembly of claim 5 wherein said securing means includes means for progressively engaging said female and male connectors between an initial condition wherein the protruding portion of said female connector is received in said cavity of said pin shield member with said shield member in said forward position and a fully engaged condition wherein said pin shield member is in said retracted position and said pins are received in said sockets.

7. The connector assembly of claim 1 wherein the shapes of the protruding portion and the cavity are axially asymmetrical.

8. The connector assembly of claim 7 wherein the side mating surfaces of said protruding portion and said cavity are complementarily tapered for improving the alignment of said connectors during engagement thereof and wherein said protruding portion is nested within said cavity when said connectors are engaged.

9. A connector assembly comprising:

a first connector having a forward end and having one or more sockets mounted thereon, each for receiving a pin and having an exposed pin entry port;

a second connector having a forward end and having one or more pins mounted thereon for being received by the respective sockets mounted in said first connector, said second connector including a pin shield member movable between a forward position wherein said pins are recessed therein to a retracted position wherein said pins are exposed from said pin shield member;

means for urging said pin shield member toward said forward position;

a protruding portion containing said sockets associated with the forward end of a one of said first and second connectors;

a complementary cavity portion containing said pins associated with the forward end of the other of said first and second connectors;

said protruding portion and said cavity portion being characterized by matching axially-asymmetrical shapes so that when said first and second connectors are mated, the protruding portion of said one connector is constrained to be received by the cavity portion of said other connector in only a single relative axial alignment.

* * * * *

UNITED STATES PATENT AND TRADEMARK OFFICE

CERTIFICATE OF CORRECTION

PATENT NO. : 4,808,127

DATED : Feb. 28, 1989

INVENTOR(S) : Anthony Swanic

It is certified that error appears in the above-identified patent and that said Letters Patent is hereby corrected as shown below:

Column 1, below "Background of the Invention" insert the following:

--This invention was made with Goverment support under Contract NAS8-35265 awarded by NASA. The Government has certain rights in this invention.--.

Signed and Sealed this

Sixth Day of February, 1990

*Attest:*

JEFFREY M. SAMUELS

*Attesting Officer*

*Acting Commissioner of Patents and Trademarks*